US005104347A

United States Patent [19]

Askeland

[11] Patent Number: 5,104,347

[45] Date of Patent: Apr. 14, 1992

[54] CAROUSEL MECHANISM

[75] Inventor: Leif J. Askeland, Cranston, R.I.

[73] Assignee: Playskool, Inc., Pawtucket, R.I.

[21] Appl. No.: 688,961

[22] Filed: Apr. 15, 1991

[51] Int. Cl.[5] ..... A63H 1/06

[52] U.S. Cl. ..... 446/241; 446/265

[58] Field of Search ..... 446/241, 236, 242-244, 446/246, 256, 259, 265; 272/31 R

[56] References Cited

U.S. PATENT DOCUMENTS

| | | | |
|---|---|---|---|
| 2,018,537 | 10/1935 | Savage . | |
| 2,213,915 | 9/1940 | Katz | 446/241 X |
| 2,841,920 | 7/1958 | Balleis | 446/241 X |
| 2,997,808 | 8/1961 | Balleis | 446/241 |
| 3,318,071 | 10/1919 | Goodman | 446/246 |
| 3,583,092 | 6/1971 | Schoenfield | 446/241 |
| 3,678,615 | 7/1972 | Balleis | 446/241 |
| 3,691,673 | 9/1972 | Balleis | 446/241 |
| 3,785,081 | 1/1974 | Burkhart | 446/241 X |
| 3,873,087 | 3/1975 | Burkhart et al. | 272/33 |
| 4,355,481 | 10/1982 | Joslyn | 446/241 |
| 4,455,781 | 6/1984 | Blumenthal | 446/241 |

FOREIGN PATENT DOCUMENTS

| | | | |
|---|---|---|---|
| 925398 | 3/1955 | Fed. Rep. of Germany | 446/241 |
| 2507159 | 9/1976 | Fed. Rep. of Germany | 446/241 |

*Primary Examiner*—Mickey Yu

*Attorney, Agent, or Firm*—Salter & Michaelson

[57] ABSTRACT

A carousel mechanism includes spaced upper and lower rotatable platforms, a plunger assembly for rotating the lower platform, and a plurality of rollers which are rotatably mounted between the upper and lower platforms and operative for communicating rotation from the lower platform to the upper platform. The plunger assembly is manually depressible and it includes a clutch assembly for rotating the lower platform as the plunger assembly is resiliently returned to an upwardly extended position.

10 Claims, 3 Drawing Sheets

CAROUSEL MECHANISM

BACKGROUND AND SUMMARY OF THE INVENTION

The instant invention relates to carousel-type toys and more particularly to an improved carousel mechanism for a toy of the general type comprising a rotatable platform and a manually depressible plunger assembly which is operative for rotating the platform about an axis.

Carousel type toys have generally been found to have relatively high levels of popularity and play value among children. For example, several of the carousel toys disclosed in the GOODMAN U.S. Pat. No. et al 1,318,071; SAVAGE U.S. Pat. No. 2,018,537; KATZ U.S. Pat. No. 2,213,915; BALLEIS U.S. Pat. No. 2,841,920; BALLEIS U.S. Pat. No. 2,997,808; SCHOENFIELD U.S. Pat. No. 3,583,092; BALLEIS U.S. Pat. No. 3,678,615; BALLEIS U.S. Pat. No. 3,691,673; BURKHART U.S. Pat. No. 3,785,081; BURKHART et al, U.S. Pat. No. 3,873,087; JOSLYN U.S. Pat. No. 4,355,481; and BLUMENTHAL U.S. Pat. No. 4,455,781, have been found to provide significant levels of amusement. However, it has also been found that the carousel mechanisms of many of the toys disclosed in these references lack sufficient durability to make them effective for use in carousel type toys for young children. Specifically, it has been found that because the rotatable platforms of many of the heretofore available carousel mechanisms are unsupported at locations which are spaced outwardly from the central rotational axes thereof, and because the rotatable platforms of many of the heretofore available carousel mechanisms are directly mechanically connected to the drive mechanisms thereof without means which permit slippage therebetween when necessary, they are incapable of withstanding the types of abuse to which toys for young children are frequently subjected. Accordingly, while the above references, which represent the closest prior art to the subject invention of which the applicant is aware, have provided a number of different types of carousel mechanisms there is nevertheless an existing need for an effective carousel mechanism which can be manufactured at a relatively low cost, and which nevertheless has sufficient durability to enable it to be effectively utilized in toys for young children.

The instant invention provides an effective carousel mechanism of the general type comprising a depressible plunger which is operative for rotating an upper platform about a central axis. However, the carousel mechanism of the instant invention is constructed so that the upper platform thereof is supported at locations which are spaced outwardly from the central rotating axis thereof, and the upper platform is connected to the plunger mechanism in a manner which permits relative slippage therebetween. Hence, the carousel mechanism of the instant invention can be effectively incorporated into a variety of different carousel toys for young children. The carousel mechanism of the instant invention comprises a base which is receivable on a supporting surface, a lower platform which is closely spaced upwardly from the base and rotatable about an axis, a manually depressible plunger assembly for rotating the lower platform about the axis thereof, an upper platform which is spaced upwardly from the lower platform and rotatable about the same axis as the lower platform, and a rotation assembly which is interposed between the upper and lower platforms and operative for communicating rotation from the lower platform to the upper platform. The rotation mechanism preferably comprises a stationary intermediate platform between the upper and lower platforms and a plurality of rollers which are rotatably mounted on the intermediate platform. The rollers are specifically mounted so that they are vertically movable relative to the intermediate platform, and so that they engage in both the upper and lower platforms for communicating rotation in a reverse direction from the lower platform to the upper platform. The lower platform is preferably mounted in closely upwardly spaced relation to base, and it is preferably adapted so that it is resiliently deflectable downwardly into engagement with the base in order to support the lower platform, the rollers, and the upper platform on the base. Further, because the rollers merely travel on the surfaces of the upper and lower platforms, the rollers permit a certain degree of slippage between the upper and lower platforms if the upper platform is forcibly held during operation of the apparatus.

The plunger assembly preferably includes telescoping upper and lower plunger sections, and the lower plunger section is preferably integrally formed with the intermediate platform. The upper platform preferably has a central opening therethrough and the lower plunger section preferably extends upwardly through the central opening in the upper platform. The plunger assembly preferably includes a twisted axial rod for rotating the lower platform during operation of the plunger assembly. Further, the plunger assembly is preferably constructed so that it is manually depressible from an upwardly extended first position to a downwardly depressed second position, and it preferably includes a clutch assembly for communicating rotation from the twisted rod to the lower platform during upward movement of the plunger assembly toward the first position thereof, but not during the downward movement of the plunger assembly toward the second position thereof.

It has been found that the carousel mechanism of the instant invention can be effectively embodied in a variety of carousel type toys for young children. Specifically, it has been found that because of the manner in which rotation is communicated from the plunger assembly to the lower platform and from the lower platform to the upper platform, the carousel mechanism of the instant invention is capable of withstanding substantial abuse. In this regard, because the upper platform is supported on the rollers and because the lower platform is downwardly deflectable, the upper platform is actually supportable on the base when the lower platform is deflected downwardly into engagement with the base. Hence, the upper platform is not readily broken as a result of the application of a downward force thereto. It has been further found that because of the manner in which the rollers are mounted on the intermediate platform so that they are interposed between the upper and lower platforms and so that they are vertically movable slightly, the rollers are effectively able to communicate rotation from the lower platform to the upper platform without significant frictional resistance. Still further, it has been found that because of the manner in which the lower section of the plunger assembly is integrally formed with the intermediate platform, the plunger assembly is also effectively supported in the carousel mechanism in a manner it which resists damage from abuse. Even still further, it has been found that because of the manner in which rotation is communicated from the lower platform to the upper platform, the carousel mechanism is not damaged in the event that a child forcibly prevents the upper platform from rotating during use thereof.

Accordingly, it is a primary object of the instant invention to provide an improved, effective and durable carousel mechanism.

Another object of the instant invention is to provide an effective and durable carousel mechanism comprising an upper platform which is rotatable about an axis and supported on a plurality of rollers which are spaced outwardly from the axis.

Other objects, features and advantages of the invention shall become apparent as the description thereof proceeds when considered in connection with the accompanying illustrative drawings.

DESCRIPTION OF THE DRAWINGS

In the drawings Which illustrate the best mode presently contemplated for carrying out the present invention.

DESCRIPTION OF THE INVENTION

Figure 1:
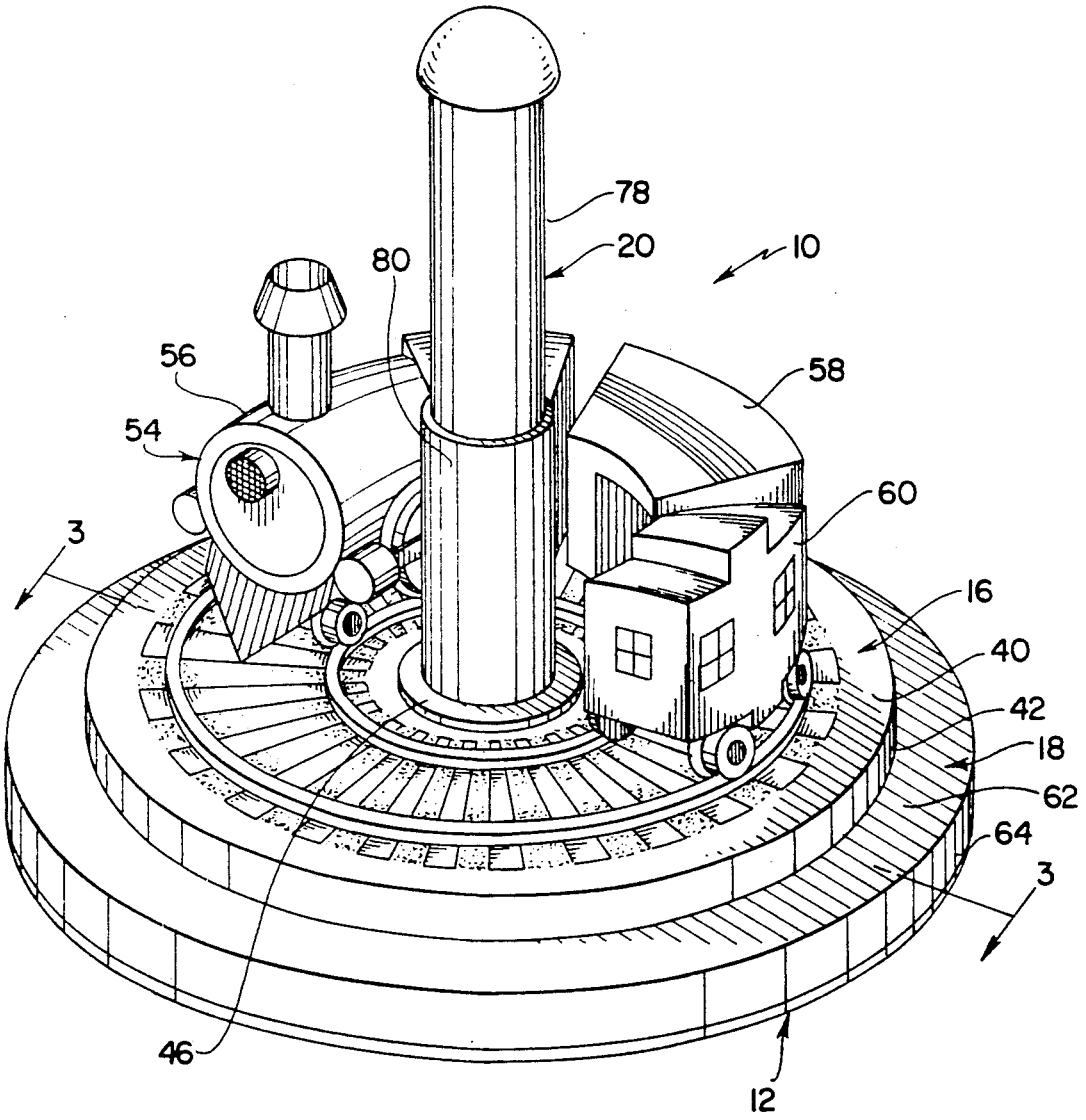
FIG. 1 is a perspective view of the carousel

Referring now to the drawings, the carousel mechanism of the instant invention is illustrated in FIGS. 1-4 and generally indicated at 10. The carousel mechanism 10 comprises a base generally indicated at 12, a lower platform generally indicated at 14, an upper platform generally indicated at 16, a rotating mechanism generally indicated at 18, and a plunger assembly generally indicated at 20. The lower platform 14 is rotatably mounted in closely upwardly spaced relation to the base 12, and the upper platform 16 is rotatably mounted in upwardly spaced relation to the lower platform 14. The rotating mechanism 18 is interposed between the upper platform 16 and the lower platform 14, and it is operative for communicating rotation from the lower platform 14 to the upper platform 16. The plunger assembly 20 is downwardly depressible from the upwardly extended first position thereof illustrated in FIG. 3, to the downwardly depressed second position thereof illustrated in FIG. 4, and it is operative for rotating the lower platform 14 upon movement of the plunger assembly 20 from the downwardly depressed second position thereof to the upwardly extended first position thereof.

The base 12 comprises a substantially flat circular plate 22 having an upwardly extending bearing face 24 formed in a central location thereon. The plate 22 is adapted to be received on a supporting surface for supporting the carousel mechanism 10 thereon, and the bearing face 24 has a rounded concave upwardly facing bearing recess or socket 26 formed in substantially the center thereof.

The lower platform 14 is also of substantially circular configuration, and it is assembled in the carousel mechanism 10 so that it is positioned in closely upwardly spaced substantially co-axial relation to the base 12. The lower platform 14 includes a plate portion 27 and it preferably includes a guide ring 28 which is formed on the upper surface of the plate portion 27. The guide ring 28 has a rounded inwardly facing surface 30 thereon, and a retaining ring 32 is formed on the upper surface of the plate portion 27 in closely inwardly spaced relation to the guide ring 28. The guide ring 28 and the retaining ring 32 are substantially co-axially oriented relative to the plate portion 27, and an enlarged central hub portion 34 is formed in the central portion of the lower platform 14. A rounded bearing knob or bump 36 extends downwardly from the hub portion 34 and is received in the socket 26 for rotatably supporting the lower platform 14 on the base 12

The upper platform 16 includes a main portion generally indicated at 38 of substantially circular configuration which includes a top plate portion 40 and a downwardly extending peripheral side wall portion 42. The top plate portion 40 has a central opening 44 formed therein, and a retaining collar 46 is provided for retaining the upper platform 16 in assembled relation with the remaining components of the carousel mechanism 10. Formed on the underside of the top plate portion 40 is an upper guide ring 48 having a rounded inwardly facing surface 50 thereon, and a retaining ring 52 is formed on the underside of the plate portion 40 in closely inwardly spaced relation to the guide ring 48. Also formed on the underside of the plate portion 40 is a bell actuator pin 53. As illustrated in FIG. 1, a train assembly generally indicated at 54 comprising a locomotive 56 and cars 58 and 60 is provided on the upper surface of the plate portion 40. The train assembly 54 is permanently attached to the plate portion 40 at a predetermined location thereon so that the train assembly 54 rotates with the plate portion 40 as the upper platform 16 is rotated about the plunger assembly 20.

The rotating mechanism 18 comprises an intermediate platform 62 of substantially circular configuration, which is supported along the outer periphery thereof by an integrally formed support ring 64 which is attached to the base 12. Formed in the intermediate platform 62 is a plurality of roller guide openings 66 having upwardly extending side walls 68. Hemispherical rollers 70 are received in the roller openings 66, the rollers 70 including axles or shafts 72 and being received in the openings 66 so that they are freely rotatable and vertically movable therein. The rollers 70 are operative for communicating rotation from the lower platform 14 to the upper platform 16. Specifically, the rollers 70 engage the inwardly facing surface 30 of the guide ring 28 on the lower platform 14 and the inwardly facing surface 50 of the guide ring 48 on the upper platform 16, and they are retained in position by the retaining rings 32 and 52. The surfaces 30 and 50 are preferably formed so that the radii of curvature thereof are substantially equal to the radius of the rollers 70, so that the rollers 70 more effectively contact the surfaces 30 and 50 to communicate rotation from the lower platform 14 to the upper platform 16. Accordingly, as the lower platform 14 is rotated the rollers 70 are also rotated and the upper platform 16 is rotated in a direction which is the reverse of the direction of rotation of the lower platform 14. Further, because the rollers 70 are vertically movable in the openings 66, they are maintained in more intimate contact with both the lower platform 14 and the upper platform 16 to more effectively communicate rotation therebetween during operation of the carousel mechanism 10.

Figure 2:
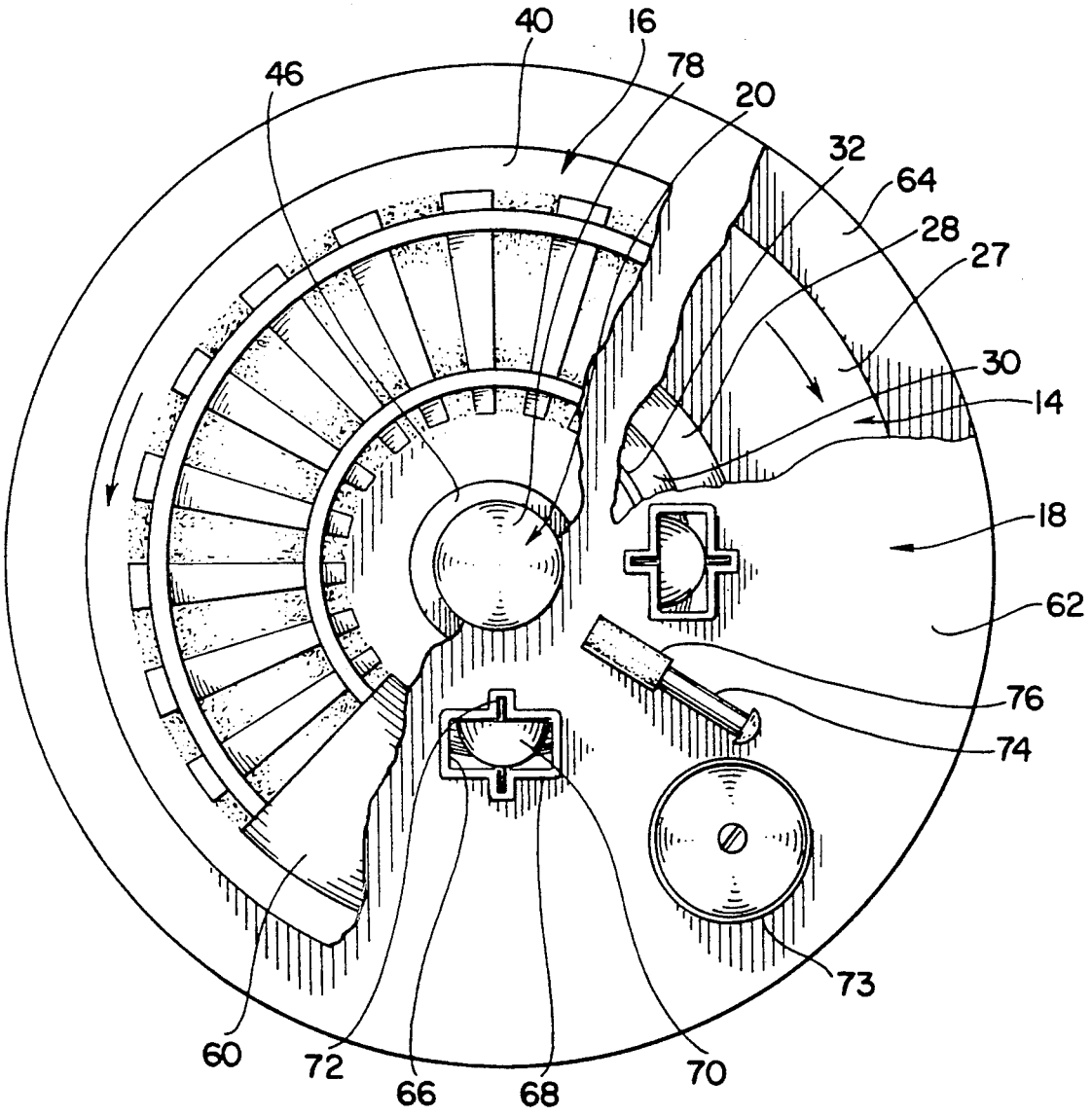
FIG. 2 is a top plan view thereof with portions of the upper platform and the intermediate platform broken away.

As illustrated in FIG. 2, also provided on the intermediate platform 62 as part of the rotating mechanism 18 is a bell 73 and a hammer 74 having a resilient base portion 76. The hammer 74 is positioned so that the actuator member 53 engages the hammer 74 to first deflect it away from the bell 73, and then release the hammer 74 so that it engages the bell 73 as the upper platform 16 is rotated.

Figure 3:
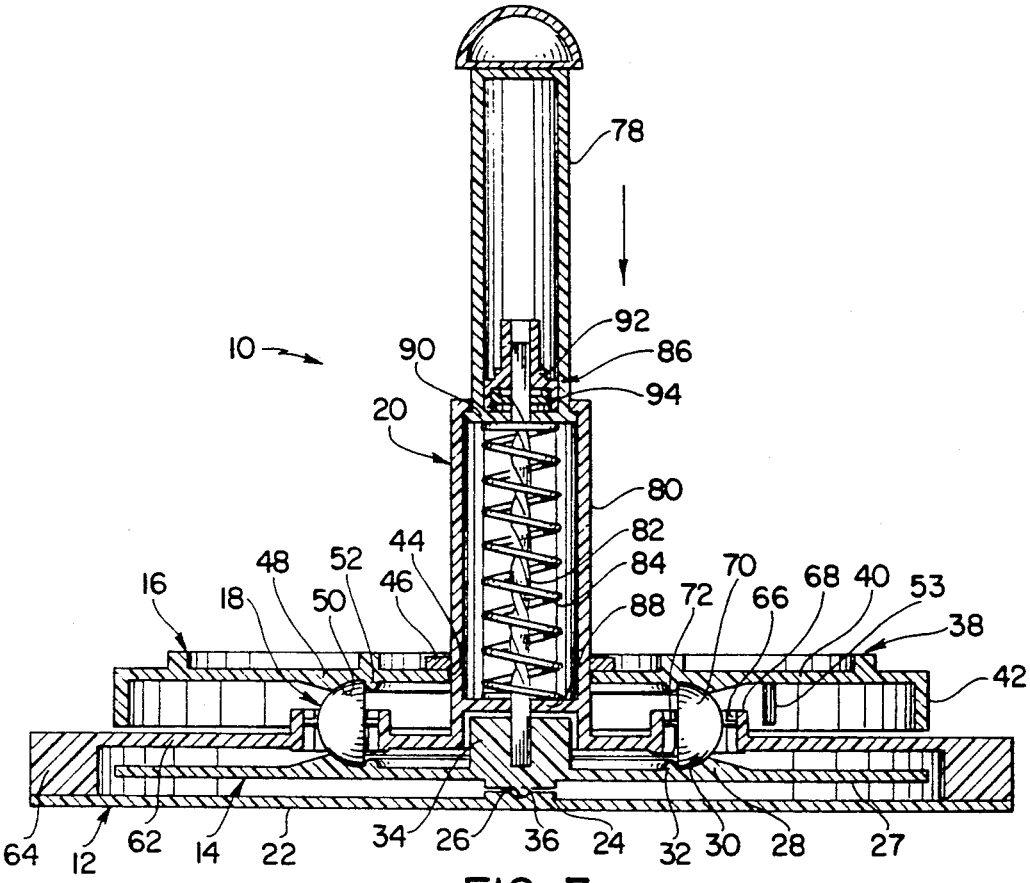
FIG. 3 is a side sectional view taken along Line 3—3 in FIG. 1.
Figure 4:
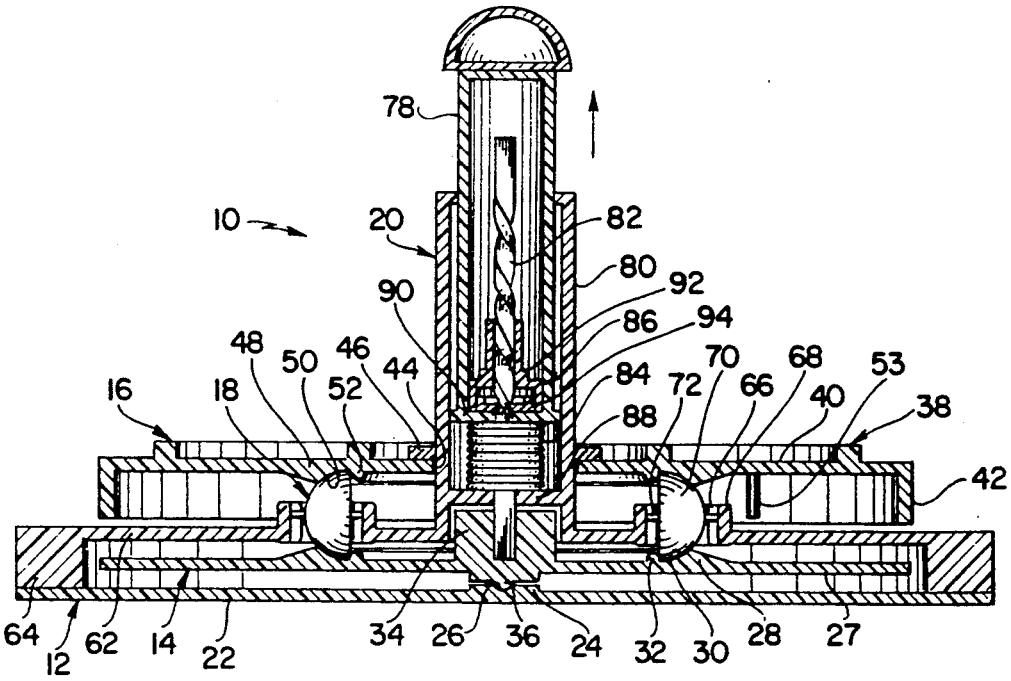
FIG. 4 is a similar sectional view with the plunger assembly in the downwardly depressed second position thereof.

The plunger assembly 20 is illustrated most clearly in FIGS. 3 and 4, and it includes telescoping upper and lower plunger sections 78 and 80, respectively. The plunger assembly 20 further includes a twisted rod 82, a coil spring 84, and a clutch assembly generally indicated at 86. The lower plunger section 80 is integrally formed with the intermediate platform 62, and it is assembled so that it passes upwardly through the opening 44 in the upper platform 16. The upper plunger section 78 is slidably received in the lower plunger section 80 and the twisted rod 82 is co-axially received in the interior of the lower plunger section 80. The twisted rod 82 is permanently and non-rotatably secured to the hub portion 34 of the lower platform 14, and the coil spring 84 is co-axially received around the twisted rod 82. The lower plunger section 80 includes a bottom wall 88 which is spaced upwardly slightly from the hub portion 34, and the twisted rod 82 is rotatably received in a central opening in the bottom wall 88. The coil spring 84 is co-axially positioned around the twisted rod 82 in the interior of the lower plunger section 80. The upper plunger section 78 includes a bottom wall 90 having a central opening therein, and the twisted rod 82 is slidably and rotatably received in the central opening in the bottom wall 90 for receiving the twisted rod 82 in the upper plunger section 78 when the upper plunger section 78 is moved to a downwardly depressed position wherein it is telescopically received in the lower plunger section 80. The clutch assembly 86 is secured in the lower portion of the upper plunger section 78, and it is operative for engaging the twisted rod 82 for rotating the twisted rod 82 and the lower platform 14 as the upper plunger section 78 is moved upwardly from the downwardly depressed second position thereof illustrated in FIG. 4, to the upwardly extended first position thereof illustrated in FIG. 3, but not when the upper plunger section 78 is moved downwardly from the first position thereof to the second position thereof. The clutch assembly 86 is of conventional construction and it includes a housing 92 and a clutch element 94. The clutch element 94 engages the twisted rod 82, so that the clutch element 94 is rotated as it is longitudinally repositioned relative to the twisted rod 82. The clutch element 94 preferably includes teeth (not shown) on the downwardly facing surface thereof which are engageable with corresponding teeth (not shown) on the upper surface of the bottom wall 90 for preventing relative rotation between the clutch element 94 and the bottom wall 90 as the upper plunger section 78 is moved upwardly. Accordingly, as the upper plunger section 78 is moved upwardly the twisted rod 82 is rotated in the interior of the lower plunger section 80 by the clutch element 94 to rotate the lower platform 14 and to thereby rotate the upper platform 16. However, as the upper plunger section 78 is moved downwardly into the lower plunger section 80, the clutch element 94 is moved upwardly away from the bottom wall 90 as the twisted rod 82 passes through the clutch element 94. As a result, the clutch element 94 is disengaged from the bottom wall 90 so that the clutch element 94 is free to rotate in the housing 92. Hence, the twisted rod 82 is only rotated by the clutch element 94 as the upper plunger section 78 is moved upwardly to the first position thereof and the twisted rod 82 remains stationary as the upper plunger section 78 is moved downwardly toward the second position thereof.

Accordingly, during the use and operation of the carousel mechanism 10, the upper plunger section 78 is depressed downwardly so that it is telescopically received in the lower plunger section 80. As the upper plunger section 78 is moved downwardly, the clutch element 94 is rotated in the housing 92 about the twisted rod 82 so that the twisted rod 82 remains substantially stationary in the lower plunger section 80. However, when the upper plunger section 78 is released, the coil spring 84 operates to return the upper plunger section 78 to the upwardly extended first position thereof illustrated in FIG. 3. As the upper plunger section 78 is moved upwardly, the teeth on the clutch element 94 are moved into engagement with the teeth on the bottom wall 90 to cause the twisted rod 82 to be rotated as the clutch element 94 is longitudinally repositioned thereon. Accordingly, as the upper plunger section 78 is moved upwardly, the lower platform 14 is rotated by the twisted rod 82. Further, the rollers 70 are rotated by the inwardly facing surface 30 on the lower platform 14, and as a result the rollers 70 function to rotate the upper platform 16 in a reverse direction relative to the lower platform 14. Accordingly, the plunger assembly 20 is operative for effectively rotating the upper platform 16 as the upper plunger section 78 is moved upwardly.

It is seen that because of its overall construction, the carousel mechanism 10 is able to effectively withstand the types of abuse to which toys for young children are normally subjected. Specifically, because of the relationship between the upper platform 16, the rollers 70, the lower platform 14, and the base 12, the lower platform 14 and the upper platform 16 are deflectable downwardly slightly until the lower platform 14 engages the base 12. Once the lower platform 14 engages the base 12, the base 12 provides support which prevents damage to the lower platform 14 and the upper platform 16. As a result, the upper platform 16 is not normally damaged by the application of a downward force thereto. Further, because of the manner in which the upper platform 16 is rotated by the lower platform 14, the carousel mechanism 10 is not normally damaged in the event that a child forcibly holds the upper platform 16 to prevent rotation thereof during operation.

It is seen therefore that the instant invention provides an effective carousel assembly. The carousel mechanism 10 can be effectively utilized for rotating a toy, such as the toy train assembly 54, about a central axis. Further, because of its overall construction the carousel mechanism 10 is resistant to breakage during normal use. Accordingly, the carousel mechanism 10 is believed to represent a significant advancement in the toy art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A carousel mechanism comprising:

a. a base adapted to be received on a supporting surface;

b. a lower platform spaced upwardly from said base and rotatable about an axis;

c. manually depressible plunger means for rotating said lower platform about said axis;

d. an upper platform spaced upwardly from said lower platform and rotatable about said axis; and e. rotation means interposed between said upper and lower platforms for communicating rotation to said upper platform from said lower platform, said rotation means comprising a plurality of rollers and retaining means interposed between said upper and lower platforms for retaining said rollers therebetween so that said rollers are vertically movable, said rollers being supported on said lower platform, said upper platform being supported on said rollers, said rollers communicating rotation from said lower platform to said upper platform.

2. In the carousel mechanism of claim 1, said rotation means comprising a stationary intermediate platform interposed between said upper and lower platforms said rollers being rotatably retained by said intermediate platform.

3. In the carousel mechanism of claim 2, said plunger means including telescoping upper and lower plunger sections, said lower plunger section being integrally formed with said intermediate platform, said upper platform having a central opening therein, said lower plunger section extendingly upwardly through the central opening in said upper platform.

4. In the carousel mechanism of claim 1, said rollers communicating rotation in a reverse direction to said upper platform.

5. In the carousel mechanism of claim 1, said lower platform being closely spaced upwardly from said base and being resiliently downwardly deflectable into engagement with said base for supporting said lower platform, said rollers and said upper platform on said base.

6. In the carousel mechanism of claim 1, said plunger means including a twisted axial rod and means engaging said twisted axial rod for rotating said lower platform during operation of said plunger means.

7. In the carousel mechanism of claim 1, said rotation means being operative for providing support for said upper platform at a plurality of locations which are spaced outwardly from said axis.

8. A carousel mechanism comprising:

a. a base adapted to be received on a supporting surface;

b. a lower platform spaced upwardly from said base and rotatable about an axis;

c. manually depressible plunger means for rotating said lower platform about said axis;

d. an upper platform spaced upwardly from said lower platform and rotatable about said axis; and e. said plunger means being manually depressible from an upwardly extended first position to a downwardly depressed second position and including spring means for returning said plunger means to said upwardly extended first position, said plunger means rotating said lower platform during movement of said plunger means from said downwardly depressed second position to said upwardly extended first position.

9. A carousel mechanism comprising:

a. a base adapted to be received on a supporting surface;

b. a lower platform spaced upwardly from said base and rotatable about an axis;

c. manually depressible plunger means for rotating said lower platform about said axis;

d. an upper platform spaced upwardly from said lower platform and rotatable about said axis; and e. rotation means interposed between said upper and lower platforms for communicating rotation to said upper platform from said lower platform, said rotation means comprising a plurality of rollers and retaining means interposed between said upper and lower platforms for retaining said rollers between said upper and lower platforms so that said rollers communicate rotation from said lower platform to said upper platform, said rollers including substantially hemispherical outer surface portions having radii, said outer surface portions facing outwardly, said upper and lower platforms having circular guide shoulders thereon for facing outwardly, said upper and lower platforms having circular guide shoulders thereon for engaging said rollers, said guide shoulders having rounded concave inwardly facing surfaces thereon having radii of curvature which are substantially equal to the radius of said rollers, said substantially hemispherical outer surface portions engaging said rounded concave surfaces for communicating rotation between said upper and lower platforms.

10. A carousel mechanism comprising:

a. a base adapted to be received on a supporting surface;

b. a lower platform spaced upwardly from said base and rotatable about an axis;

c. manually depressible plunger means for rotating said lower platform about said axis;

d. an upper platform spaced upwardly from said lower platform and rotatable about said axis; and e. rotation means interposed between said upper and lower platforms for communicating rotation to said upper platform from said lower platform, said rotation means comprising a plurality of rollers and retaining means interposed between said upper and lower platforms for retaining said rollers in vertically movable relation between said upper and lower platforms so that said rollers communicate rotation from said lower platform to said upper platform.

* * * * *